US007502575B2

(12) United States Patent
Tanaka et al.

(10) Patent No.: US 7,502,575 B2
(45) Date of Patent: Mar. 10, 2009

(54) IMAGE FORMING APPARATUS AND METHOD OF TRANSFERRING IMAGE TO INTERMEDIATE TRANSFER BODY BY CONTROLLING THE DRIVE OF A PHOTOSENSITIVE BODY

(75) Inventors: Toru Tanaka, Niigata (JP); Noribumi Sato, Saitama (JP); Tomoya Saeki, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 414 days.

(21) Appl. No.: 11/399,480

(22) Filed: Apr. 7, 2006

(65) Prior Publication Data

US 2007/0059040 A1 Mar. 15, 2007

(30) Foreign Application Priority Data

Sep. 9, 2005 (JP) ..... 2005-262816

(51) Int. Cl.
*G03G 15/00* (2006.01)

(52) U.S. Cl. ..... 399/167

(58) Field of Classification Search ..... 399/66, 399/167, 301, 302

See application file for complete search history.

(56) References Cited

U.S. PATENT DOCUMENTS 6,980,749 B2 * 12/2005 Yoda et al. ..... 399/66

FOREIGN PATENT DOCUMENTS

JP 2004-302308 10/2004

* cited by examiner

*Primary Examiner*—William J Royer
(74) *Attorney, Agent, or Firm*—Sughrue Mion, PLLC

(57) ABSTRACT

An image forming apparatus including: a photosensitive body; a drive unit of the photosensitive body; an intermediate transfer body which is wound around the photosensitive body and is driven by the movement of the photosensitive body; a latent image forming unit; plural development units which develop the latent image on the photosensitive body with toners having different colors; a holding unit which holds the plural development units and causes the development units to sequentially face the photosensitive body; a transfer unit which transfers a toner image from the photosensitive body to the portion of the intermediate transfer body wound around the photosensitive body; and a drive speed control unit which controls the rotating speed of the photosensitive body according to the density of the toner image to be formed.

16 Claims, 8 Drawing Sheets

IMAGE FORMING APPARATUS AND METHOD OF TRANSFERRING IMAGE TO INTERMEDIATE TRANSFER BODY BY CONTROLLING THE DRIVE OF A PHOTOSENSITIVE BODY

CROSS-REFERENCE TO RELATED APPLICATION

This application claims priority under 35 USC 119 from Japanese Patent Application No. 2005-262816, the disclosure of which is incorporated by reference herein.

BACKGROUND OF THE INVENTION

1. Field of the Invention

The present invention relates to an image forming apparatus equipped with an intermediate transfer body which is wound around a photosensitive body and rotated by being driven by the rotation of the photosensitive body. In the image forming apparatus, the intermediate transfer body is rotated more than once, respective color toner images are superimposed on the intermediate transfer body with each complete circuit of the intermediate transfer body, and thereby a full-color toner image is formed on the intermediate transfer body.

2. Description of the Related Art

In a four cycle type full-color laser printer in which a full-color toner image including yellow (Y), magenta (M), cyan (C), and black (K) colors are formed on an intermediate transfer belt with one photosensitive body, the intermediate transfer belt makes four turns (i.e., is rotated four times), and respective color toner images are superimposed on the intermediate transfer belt with each turn of the intermediate transfer belt. Therefore, in the four cycle type full-color laser printer, in order to suppress generation of color shift, a fluctuation (variation) in rotation period of the intermediate transfer belt is detected, and the timing of the start of sub-scanning to a photosensitive body (drum) by an exposure device is controlled according to the fluctuation.

A fluctuation in load applied to the intermediate transfer belt due to a transfer roller, a cleaning blade or a cleaning roller contacting with or separating from the intermediate transfer belt, can be a factor in the fluctuation in the rotation period of the intermediate transfer belt. Conventionally the start timing of the sub-scanning to the photosensitive drum by the exposure device is controlled in consideration of the fluctuation in the load applied to the intermediate transfer belt (for example, see Japanese Patent Application Laid-Open (JP-A) No. 2004-302308).

A change in drive radius of the photosensitive drum due to a change in the amount of toner which is electrostatically adsorbed onto the photosensitive drum, can be another factor in fluctuation in the rotation period of the intermediate transfer belt. The change in drive radius of the photosensitive drum occurs in a configuration in which the intermediate transfer belt is wound around the photosensitive drum and rotated by being driven by the rotation of the photosensitive drum. As shown in FIGS. 7A and 7D, when a small amount of toner is electrostatically adsorbed to a photosensitive drum 50, a drive radius R0 of the photosensitive drum 50 is substantially equal to an actual radius R of the photosensitive drum 50, and a moving speed Vb of an intermediate transfer belt 64 is substantially equal to a rotation speed Vd of the photosensitive drum 50. On the contrary, as shown in FIGS. 7B and 7C, when a large amount of toner is electrostatically adsorbed to the photosensitive drum 50, the drive radius R0 of the photosensitive drum 50 is increased by a thickness of toner, and the moving speed Vb of the intermediate transfer belt 64 becomes faster than the rotation speed Vd of the photosensitive drum 50. This is clear from the fact that, when performing a full-color print with a Y color coverage rate ranging from 2 to 3%, a M color coverage rate of 100%, a C color coverage rate of 100%, and a K color coverage rate ranging from 2 to 3%, the rotation period of the intermediate transfer belt 64 when performing primary transfer of the M color and C color becomes shorter than the rotation period of the intermediate transfer belt 64 when performing primary transfer of the Y color and K color.

Therefore, as shown in FIGS. 8A and 8B, when a small amount of toner is electrostatically adsorbed to the photosensitive drum 50, for example, in a case in which a pitch of a toner image T on the photosensitive drum 50 is L0, the pitch on the intermediate transfer belt 64 also becomes L0. On the other hand, as shown in FIGS. 8C and 8D, when a large amount of toner is electrostatically adsorbed to the photosensitive drum 50, even if the pitch of the toner image T on the photosensitive drum 50 is L0 similarly to the former case, the pitch on the intermediate transfer belt 64 becomes L1 (>L0). Accordingly, even if the start timing of sub-scanning is adjusted for each color, the color displacement will gradually increase while transferring the toner image from the photosensitive drum 50 to the intermediate transfer belt 64.

SUMMARY OF THE INVENTION

In view of the foregoing, the present invention is to provide an image forming apparatus and a method of transferring an image to an intermediate transfer body that can suppress fluctuations in the rotation period of the photosensitive body due to changes in the amount of toner which is electrostatically adsorbed to the photosensitive body.

A first aspect of the invention is an image forming apparatus including: a photosensitive body; a drive unit of the photosensitive body; an intermediate transfer body which is wound around the photosensitive body, the intermediate transfer body being driven by the movement of the driven photosensitive body; a latent image forming unit which forms an electrostatic latent image on the photosensitive body according to image information; a plurality of development units which develop the electrostatic latent image on the photosensitive body with toners respectively having different colors; a holding unit which holds the plurality of development units, the holding unit causing the development units to sequentially face the photosensitive body; a transfer unit which transfers a toner image from the photosensitive body to a portion of the intermediate transfer body where the intermediate transfer body is wound around the photosensitive body; and a drive speed control unit which controls the drive unit of the photosensitive body according to density of the toner image to be formed on the photosensitive body.

In the image forming apparatus of the first aspect of the invention, the latent image forming unit forms an electrostatic latent image, on the photosensitive body driven by the drive unit, according to the image information, and the development unit develops the electrostatic latent image on the photosensitive body with toners. Then, the transfer unit transfers the toner image from the photosensitive body to the portion of the intermediate transfer body where the intermediate transfer body is wound around the photosensitive body. The above operation is repeated by rotating the holding unit to cause each of the development units to sequentially face the photosensitive body, and thereby toner images having different colors are superimposed on the intermediate transfer body one by one to form a full-color toner image on the intermediate transfer body.

The intermediate transfer body is wound around the photosensitive body and driven by the rotation of the photosensitive body. Therefore, the drive speed of the intermediate transfer body fluctuates when the drive radius of the photosensitive body is changed due to a change in the amount of toner which is electrostatically adsorbed to the photosensitive body.

In the image forming apparatus of the first aspect of the invention, the drive speed control unit controls the drive unit such that the drive speed of the photosensitive body is changed according to the density of the toner image which is to be formed on the photosensitive body. For example, in the case where the toner image to be formed on the photosensitive body has high density, the drive speed of the photosensitive body is decreased so that the position on the photosensitive body, where the electrostatic latent image is formed by the latent image forming unit, moves toward the downstream side in a rotation direction, and the timing at which the toner image reaches a transfer position is made to be earlier. On the other hand, the speed of the intermediate transfer body is increased due to the increase of the drive radius of the photosensitive body, and the timing at which the intermediate transfer body passes through the transfer position becomes faster. Thus a delay in the timing at which the toner image is transferred from the photosensitive body to the intermediate transfer body is suppressed.

The present invention may also be provided as a method applicable to an image forming apparatus. That is, a second aspect of the invention is a method of transferring an image to an intermediate transfer body, including: forming a toner image on a photosensitive body while driving the photosensitive body; controlling the driving according to the density of the toner image to be formed; and transferring the toner image from the photosensitive body to the intermediate transfer body.

BRIEF DESCRIPTION OF THE DRAWINGS

A preferred embodiment of the present invention will be described in detail based on the following figures, wherein.

DETAILED DESCRIPTION OF THE INVENTION

One embodiment of the present invention will be described below with reference to the drawings.

Figure 1:
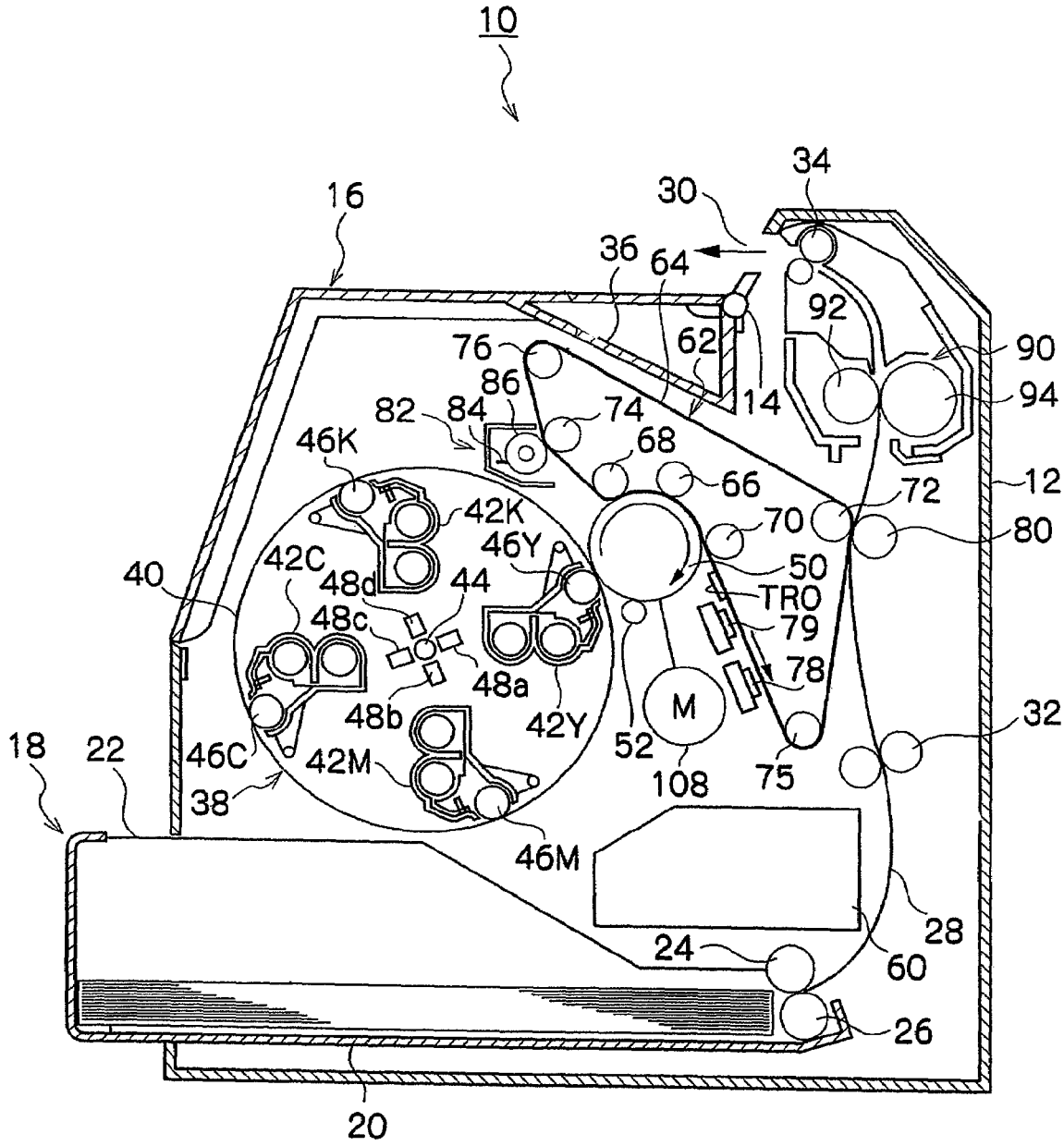
FIG. 1 is a schematic sectional view showing an image forming apparatus according to an embodiment of the present invention.

FIG. 1 schematically shows an image forming apparatus 10 according to the embodiment of the invention. The image forming apparatus 10 includes an image forming apparatus main body 12. An opening and closing cover 16 which is rotatable about a rotation fulcrum 14 is provided at an upper portion of the image forming apparatus main body 12, and a paper feeding unit 18, for example, a one-stage type, is disposed at a lower portion of the image forming apparatus main body 12.

The paper feeding unit 18 includes a paper feeding unit main body 20 and a paper feeding cassette 22 in which sheets are stored. A feeding roller 24 and a retarding roller 26 are disposed at an upper portion near an inner end of the paper feeding cassette 22. The feeding roller 24 supplies a sheet P from the paper feeding cassette 22, and the retarding roller 26 handles the supplied sheets one by one.

A conveyance path 28 is a sheet path from the feeding roller 24 to a discharge opening 30. The conveyance path 28 is located near the backside (right side of FIG. 1) of the image forming apparatus main body 12, and is formed substantially vertically from the paper feeding unit 18 to a fixing device 90, which is described below. A secondary transfer roller 80 and a secondary transfer backup roller 72, which are also described below, are disposed at an upstream side of the fixing device 90 of the conveyance path 28. A registration roller 32 is disposed at the upstream side of the secondary transfer roller 80 and the secondary transfer backup roller 72. A discharge roller 34 is disposed near the discharge opening 30 of the conveyance path 28.

A sheet fed from the paper feeding cassette 22 of the paper feeding unit 18 by the feeding roller 24 is handled by the retarding roller 26 and only the uppermost sheet is conveyed to the conveyance path 28. The sheet is temporarily stopped by the registration roller 32, and a toner image is transferred to the sheet while the sheet passes between the secondary transfer roller 80 and the secondary transfer backup roller 72 at predetermined timing. The transferred toner image is fixed to the sheet by the fixing device 90, and the sheet is discharged by the discharge roller 34 from the discharge opening 30 to a discharge unit 36 provided in the upper portion of the opening and closing cover 16. The discharge unit 36 is inclined such that a portion near the discharge opening 30 is lowered, and gradually rises toward a front-face direction of the apparatus 10 (left side of FIG. 1).

A rotary development device 38 is disposed at a substantially center portion of the image forming apparatus main body 12. The rotary development device 38 includes development devices 42Y, 42M, 42C and 42K, in a development device main body 40, in which four color toner images of Y, M, C, and K are respectively formed. The development devices 42Y, 42M, 42C and 42K are rotated in a counter-clockwise direction, in FIG. 1, about a center 44 of the rotary development device 38. The development devices 42Y, 42M, 42C and 42K respectively include development rollers 46Y, 46M, 46C and 46K. The development rollers 46Y, 46M, 46C and 46K are pressed in a direction normal to the development device main body 40 by elastic bodies 48*a* to 48*d* such as coil springs.

A photosensitive drum 50, which is rotated about a rotation shaft thereof, is disposed so as to abut to the rotary development device 38. A part of the outer periphery of each of the development rollers 46Y, 46M, 46C and 46K is projected from an outer periphery of the development device main body 40, e.g., by 2 mm, in a radial direction of the development device main body 40, in a state in which each of the development rollers 46Y, 46M, 46C and 46K does not abut to the photosensitive drum 50. Tracking rollers (not shown) having diameters slightly larger than that of each of the development rollers 46Y, 46M, 46C and 46K are provided at both ends of each of the development rollers 46Y, 46M, 46C and 46K so as to be rotated coaxially with the development rollers 46Y, 46M, 46C and 46K. That is, the development rollers 46Y, 46M, 46C and 46K of the development devices 42Y, 42M, 42C and 42K are disposed at the outer periphery of the development device main body 40 around the rotary development device center 44 at intervals of 90°, the tracking rollers of the development rollers 46Y, 46M, 46C and 46K abut on flanges (not shown) provided at both ends of the photosensitive drum 50, and a latent image on the photosensitive drum 50 is developed with the toner of each color while a predetermined interval is formed between each of the development rollers 46Y, 46M, 46C and 46K and the photosensitive drum 50.

A charging device 52 is provided below the photosensitive drum 50. For example, the charging device 52 includes a charging roller which uniformly charges the photosensitive drum 50. An exposure device 60 is disposed at the backside below the rotary development device 38. The exposure device 60 writes the latent image on the photosensitive drum 50, which is charged by the charging device 52, with a light beam such as a laser beam. An intermediate transfer device 62 is provided above the rotary development device 38. The toner image, which is visualized by the rotary development device 38, is transferred to the intermediate transfer device 62 at a primary transfer position. Then, the intermediate transfer device 62 conveys the transferred image to the secondary transfer position which is to be described below.

The intermediate transfer device 62 includes an intermediate transfer belt 64, a primary transfer roller 66, a wrap-in roller 68, a wrap-out roller 70, a secondary transfer backup roller 72, a brushing back-up roller 74, and tension rollers 75 and 76.

The intermediate transfer belt 64 has elasticity, and is tensioned in substantially flat form above the rotary development device 38. The intermediate transfer belt 64 is tensioned such that a side on the upper surface side 96 thereof is substantially parallel to, for example, the discharge unit 36 provided at the upper portion of the image forming apparatus main body 12. The intermediate transfer belt 64 also has a primary transfer portion (photosensitive drum wrapping region) which comes into contact with the photosensitive drum 50 in a manner such that it wraps around the photosensitive drum 50 between the wrap-in roller 68, which is disposed at the upstream side of the primary transfer roller 66 and in the lower portion of the immediate transfer belt 64, and the wrap-out roller 70, which is disposed at the downstream side of the primary transfer roller 66. The intermediate transfer belt 64 is wound around the photosensitive drum 50 only for a predetermined range and is driven by the rotation of the photosensitive drum 50. Therefore, since a dedicated drive source for rotating the intermediate transfer belt 64 is eliminated, costs can be reduced.

Thus, the primary transfer is performed by superposing the toner images on the photosensitive drum 50 onto the intermediate transfer belt 64 in the order of the Y, M, C, and K colors by the primary transfer roller 66, and the intermediate transfer belt 64 conveys the primary-transferred toner image to the secondary transfer roller 80. The wrap-in roller 68 and the wrap-out roller 70 are separated from the photosensitive drum 50.

The intermediate transfer belt 64 is tensioned by six rollers, namely the wrap-in roller 68, the wrap-out roller 70, the secondary transfer backup roller 72, the brushing backup roller 74 and the tension rollers 75 and 76, and the toner image on the photosensitive drum 50 is transferred to the intermediate transfer belt 64 by the primary transfer roller 66.

A flat portion is formed on the backside (right side surface of FIG. 1) of the intermediate transfer belt 64 by the tension roller 75 and the secondary transfer backup roller 72, and the flat portion faces the conveyance path 28 as a secondary transfer portion.

The brushing backup roller 74 assists a brushing roller 86 to scrape (sweep) off waste (residual) toner remaining on the intermediate transfer belt 64 after the secondary transfer.

Sensors 78 and 79 such as reflection photosensors are provided below the intermediate transfer belt 64. The sensor 78 detects toner density by reading a patch of the toner formed on the intermediate transfer belt 64. The sensor 79 detects a position of a belt position detection mark TR0 formed on the intermediate transfer belt 64.

The secondary transfer roller 80 faces the secondary transfer backup roller 72 of the intermediate transfer device 62 across the conveyance path 28. That is, in a second transfer portion, the secondary transfer position is formed between the secondary transfer roller 80 and the secondary transfer backup roller 72, and the secondary transfer roller 80 performs the secondary transfer of the toner image primary-transferred onto the intermediate transfer belt 64 to a sheet at the secondary transfer position with the assistance of the secondary transfer backup roller 72.

Here, the secondary transfer roller 80 is separated from the intermediate transfer belt 64 while the intermediate transfer belt 64 makes three turns, namely while the three color toner images of the Y, M, and C colors are conveyed, and the secondary transfer roller 80 abuts on the intermediate transfer belt 64 when the toner image of the K color is transferred.

A predetermined potential difference is generated between the secondary transfer roller 80 and the secondary transfer backup roller 72. For example, when high voltage is applied to the secondary transfer roller 80, the secondary transfer backup roller 72 is connected to a ground (GND), i.e., grounded.

An intermediate transfer belt cleaner 82 is provided at the intermediate transfer belt 64. The intermediate transfer belt cleaner 82 includes a scraper 84, the brushing roller 86, and a toner recovery bottle (not shown). The intermediate transfer belt cleaner 82 is configured to oscillate (swing) about a rotation shaft (not shown). The brushing roller 86 scrapes off waste toner on the intermediate transfer belt 64. The scraper 84 cleans the brushing roller 86 by scraping down the waste toner adhering to the brushing roller 86. The toner recovery bottle recovers the toner scraped down by the scraper 84. The scraper 84 is formed, for example, by a stainless-steel thin plate.

The brushing roller 86 is formed by, e.g., an acrylic brush on which a conductivity treatment has been performed. The brushing roller 86 is separated from the intermediate transfer belt 64 while the intermediate transfer belt 64 conveys the toner image, and abuts to the intermediate transfer belt 64 at predetermined timing.

The fixing device 90 is arranged above the secondary transfer position. The fixing device 90 includes a heating roller 92 and a pressuring roller 94. The fixing device 90 fixes the toner image secondary-transferred by the secondary transfer roller 80 and the secondary transfer backup roller 72 to the sheet, and conveys the sheet to the discharge roller 34.

Figure 2:
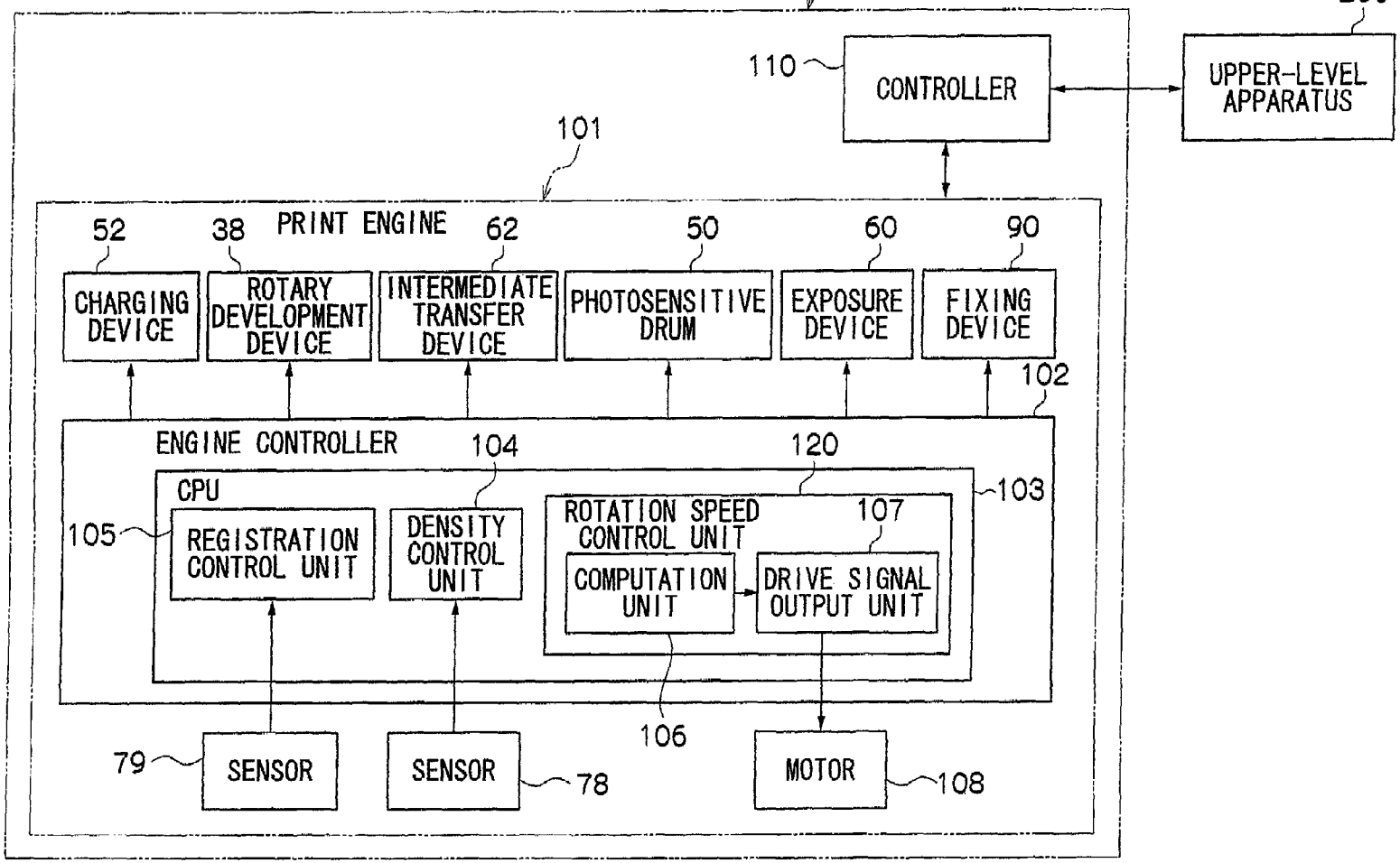
FIG. 2 is a block diagram showing a configuration of a control system of the image forming apparatus according to the embodiment of the invention.

A circuit configuration of a control system of the image forming apparatus 10 will be described with reference to FIG. 2. The image forming apparatus 10 includes a print engine 101 and a controller 110. The print engine 101 includes drive units such as the rotary development device 38 and the intermediate transfer device 62. The controller 110 is connected to the print engine 101 and an upper-level apparatus 200 such as a host computer and/or a scanner. The controller 110 controls power supply and the like, analyzes picture data and print command information included in image data, converts the image data into a form compatible with the print engine 101 (for example, bitmap data), and outputs the image data to an engine controller 102 of the print engine 101. The engine controller 102 controls drive of the charging device 52, the rotary development device 38, the intermediate transfer device 62, the photosensitive drum 50, the exposure device 60, the fixing device 90, and the like. CPU 103 is provided in the engine controller 102.

A speed-variable motor 108 which rotates the photosensitive drum 50 is connected to CPU 103, and a rotation speed control unit 120 which controls the drive of the motor 108 is provided in CPU 103. The rotation speed control unit 120 includes a computation unit 106 and a drive signal output unit 107. The computation unit 106 analyzes the image data to compute image density information, and computes the optimum rotation speed of the motor 108 with respect to the image density information. The drive signal output unit 107 outputs a drive control signal to the motor 108 according to the computation result computed by the computation unit 106.

Further, CPU 103 is connected to the sensors 78 and 79, and includes a density control unit 104 and a registration control unit 105. The density control unit 104 controls image density based on input from the sensor 78, and the registration control unit 105 controls the start timing of the sub-scan based on input from the sensor 79.

Next, operation of the above configured embodiment will be described.

When an image forming signal is transmitted from the upper-level apparatus 200, the photosensitive drum 50 is uniformly charged by the charging device 52, and a light beam is irradiated to the charged photosensitive drum 50 from the exposure device 60 based on the image forming signal. The surface of the photosensitive drum 50 is exposed with the light beam from the exposure device 60 in order to form the latent image. The latent image formed on the photosensitive drum 50 by the exposure device 60 is developed into Y, M, C, and K toner images by the rotary development device 38, and the Y, M, C, and K toner images are primary-transferred to the intermediate transfer belt 64 and superimposed on one another.

On the other hand, a sheet stored in the paper feeding cassette 22 is fed, in response to a paper feeding signal or the like, by the feeding roller 24, handled and guided to the conveyance path 28 by the retarding roller 26, temporarily stopped by the registration roller 32, and then conveyed between the secondary transfer roller 80 and the secondary transfer backup roller 72 at predetermined timing. When the sheet is conveyed between the secondary transfer roller 80 and the secondary transfer backup roller 72, the toner image primary-transferred to the intermediate transfer belt 64 is secondary-transferred to the sheet by the secondary transfer roller 80 and the secondary transfer backup roller 72. After the secondary transfer, the waste toner remaining on the intermediate transfer belt 64 is scraped off by the intermediate transfer belt cleaner 82, and the waste toner is recovered.

The sheet to which the toner image is transferred is conveyed to the fixing device 90, and the toner image is fixed by the heat and pressure generated by the heating roller 92 and pressurizing roller 94. The sheet to which the toner image is fixed is discharged from the discharge opening 30 to the discharge unit 36 by the discharge roller 34.

Figure 3:
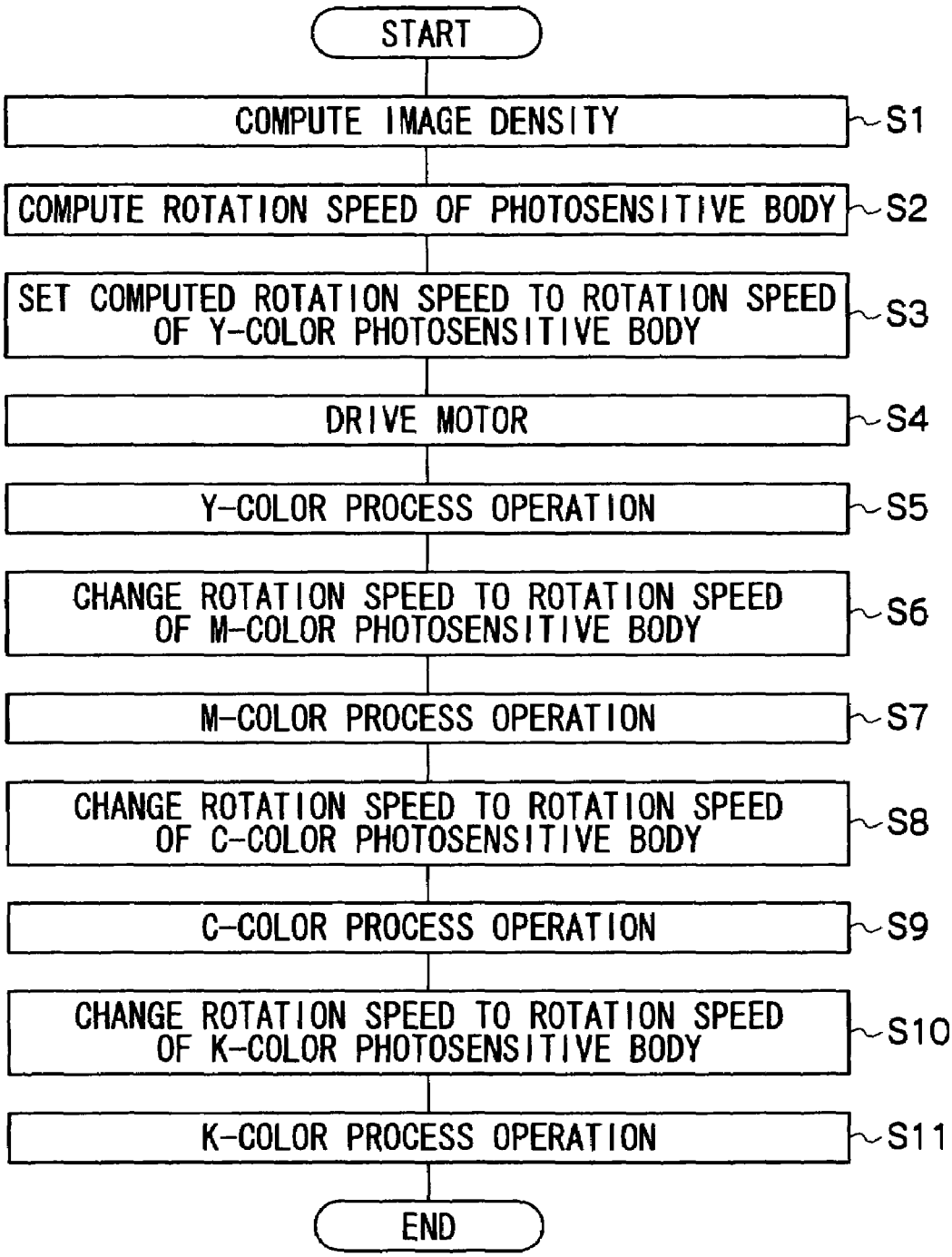
FIG. 3 is a flowchart illustrating a method of controlling the rotation speed of a photosensitive drum in the image forming apparatus according to the embodiment of the invention.

A method of controlling the rotation speed of the photosensitive drum 50 will be described with reference to the flowchart of FIG. 3. A case in which a full-color print having a Y color coverage rate ranging from 2 to 3%, an M color coverage rate of 100%, a C color coverage rate of 100%, and a K color coverage rate ranging from 2 to 3% is performed will be described by way of example.

When the controller 110 receives image data from the upper-level apparatus 200, a processing routine is started, and the process proceeds to Step S1. In Step S1, the computation unit 106 computes image density of each of the Y, M, C, and K colors by a pixel count method. Next in Step S2, the computation unit 106 computes an optimum rotation speed of the motor 108 with respect to the image density information of each color computed in Step S1. Here, a computation expression or a parameter table for computing the rotation speed of the motor 108 is stored in the computation unit 106. The computation expression or the parameter table uses a correlation whereby, given that image density of 0% is the maximum speed and image density of 100% is the minimum speed, the rotation speed of the motor 108 is gradually decreased as the image density increases.

Figure 4A:
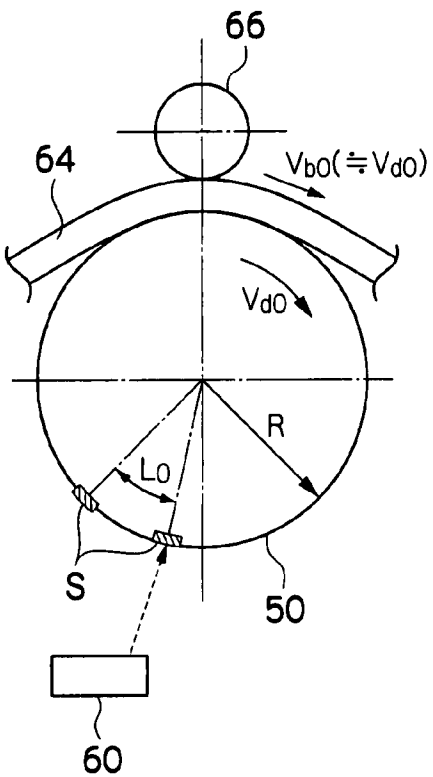
FIGS. 4A to 4C are explanatory views showing the operation of the photosensitive drum and an intermediate transfer belt in the image forming apparatus according to the embodiment of the invention.
Figure 4B:
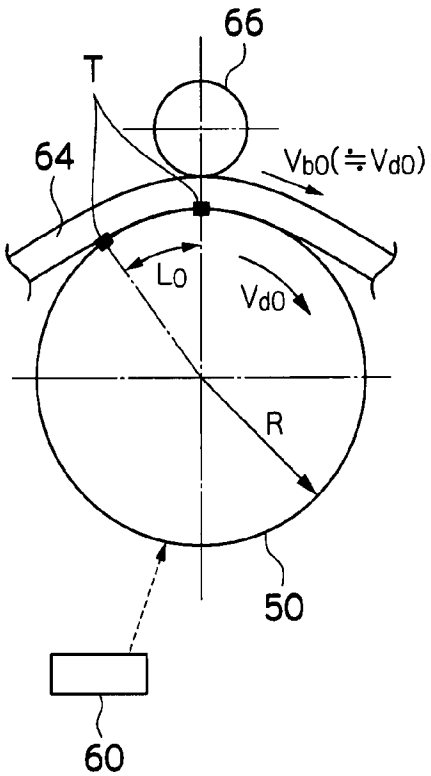
Figure 4C:
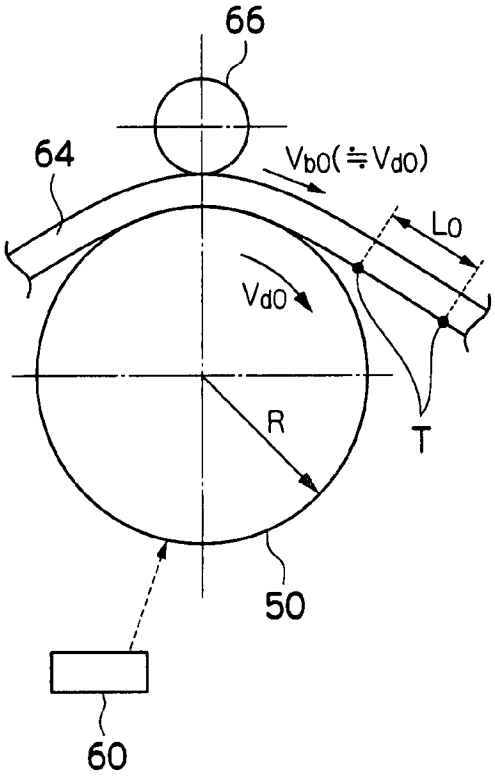

In Step S3, the drive signal output unit 107 outputs a drive control signal to the motor 108 to set the rotation speed of the motor 108 at the optimum value, which is computed in Step S2, with respect to the image density of the Y color. In Step S4, as shown in FIGS. 4A to 4C, the motor 108 is driven, and the photosensitive drum 50 is rotated at the optimum rotation speed Vd0 with respect to the density (coverage rate of 2 to 3%) of the Y-color toner image which is to be electrostatically adsorbed on the photosensitive drum 50. In Step S5, the photosensitive drum 50 is uniformly charged by the charging device 52, the photosensitive drum 50 is exposed by the exposure device 60 according to the Y-color image data, the latent image on the photosensitive drum 50 is developed with the Y-color toner by the development device 42Y, and the Y-color toner image is primary-transferred from the photosensitive drum 50 to the intermediate transfer belt 64 at a transfer nip portion (the primary transfer portion) between the primary transfer roller 66 and the photosensitive drum 50.

Here, a method of controlling the start timing of process operations of the charging, the exposure, the development, and the transfer of the Y-color and each of the M, C, and K colors will be described below.

Figure 6:
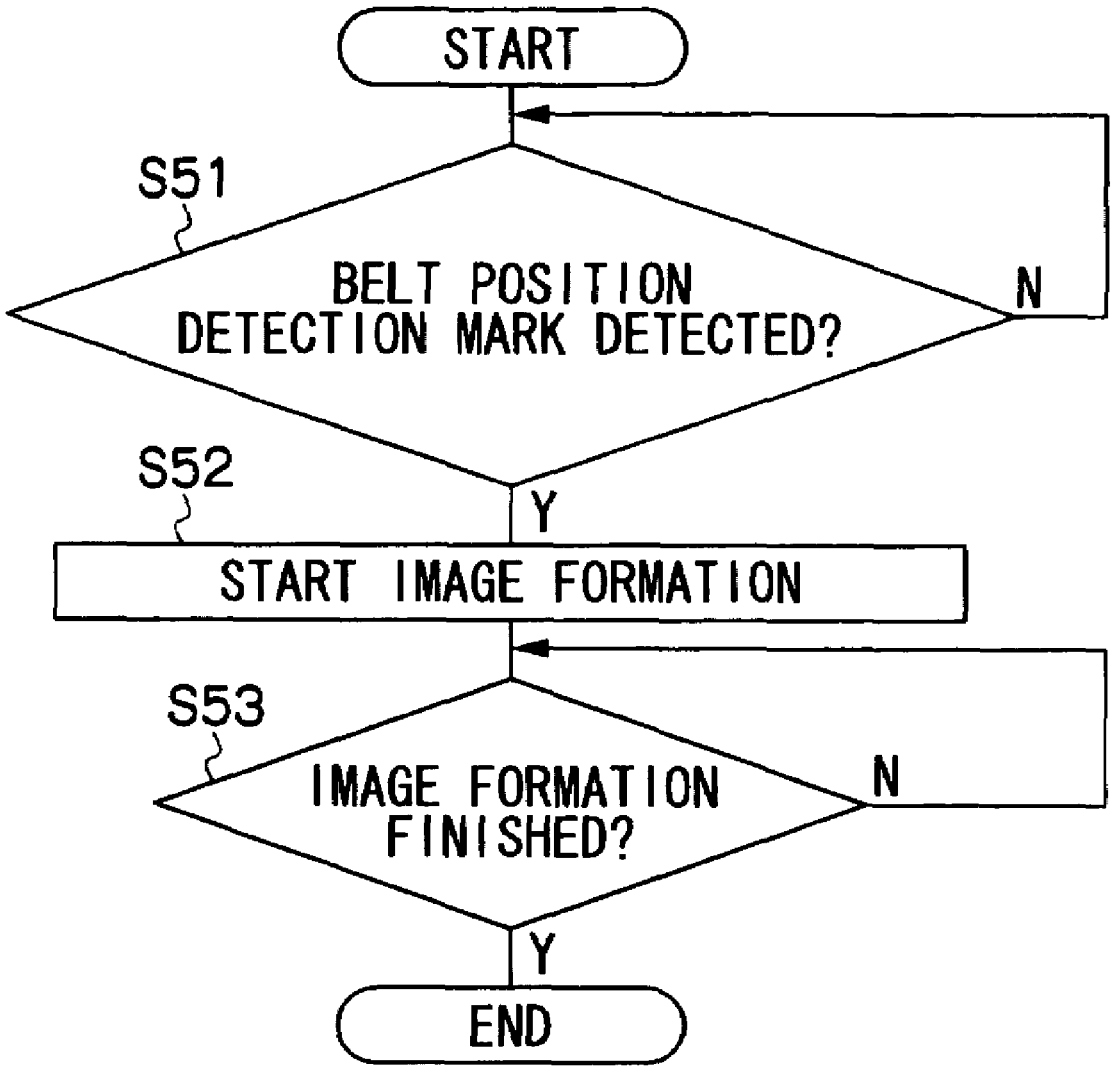
FIG. 6 is a flowchart illustrating a method of controlling the start timing of a process operation in the image forming apparatus according to the embodiment of the invention.

In Step S51 of FIG. 6, a negative determination is repeatedly made until the sensor 79 detects the belt position detection mark TR0 on the intermediate transfer belt 64. When an affirmative determination is made, the process proceeds to Step S52. In Step S52, the exposure of the photosensitive drum 50 is started by the exposure device 60 after a predetermined time has elapsed since the sensor 79 detected the belt position detection mark TR0. Thus, writing positions of the toner images of the Y, M, C, and K colors are aligned on the intermediate transfer belt 64. In Step S53, a negative determination is repeatedly made until transferring of the toner images of the Y, M, C, and K colors is completed. When an affirmative determination is made, the process proceeds to Step S6 in the flowchart of FIG. 3.

Figure 7A:
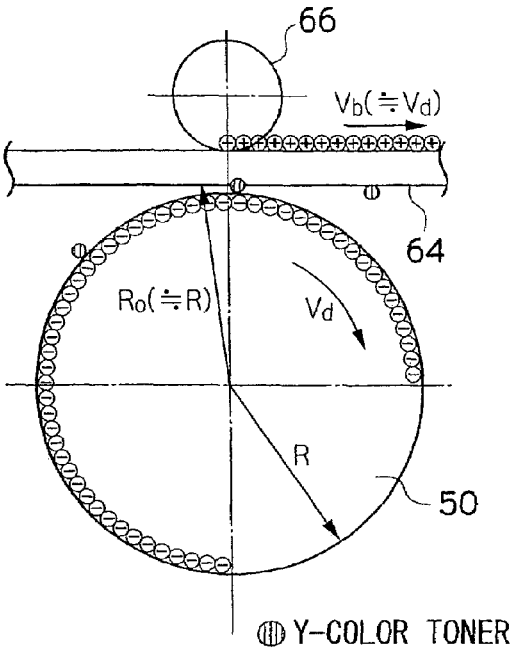
FIGS. 7A to 7D are explanatory views showing fluctuations in the drive radius of the photosensitive drum and fluctuations in the moving speed of the intermediate transfer belt due to a change in the amount of toner electrostatically adsorbed to the photosensitive drum.

In the Y-color process operation, as shown in FIG. 7A, since the amount of Y-color toner which is electrostatically adsorbed on the photosensitive drum 50 is small, the drive radius R0 of the photosensitive drum 50 is substantially equal to the actual radius R of the photosensitive drum 50. Therefore, as shown in FIGS. 4A to 4C, the moving speed Vb of the intermediate transfer belt 64 is substantially equal to the rotation speed Vd of the photosensitive drum 50. Accordingly, as shown in FIGS. 4A and 4B, when the exposure device 60 forms electrostatic latent images S on the photosensitive drum 50 at a pitch of L0, and forms toner images T on the photosensitive drum 50 at the pitch of L0, the pitch of the toner images T which is transferred to the intermediate transfer belt 64, is also substantially equal to the pitch of L0, as shown in FIG. 4C.

Figure 5A:
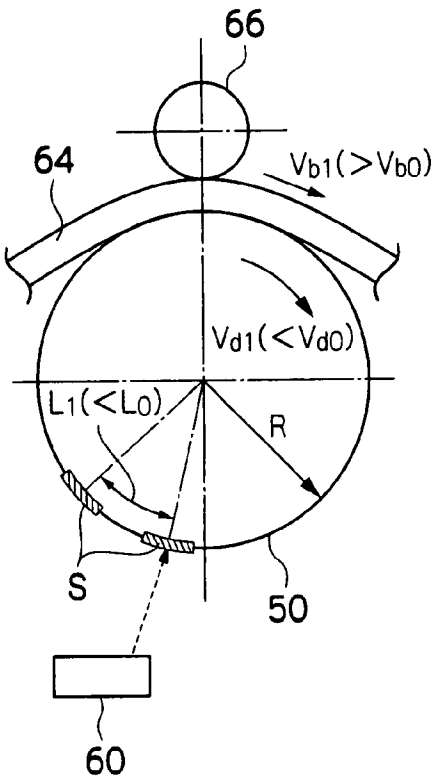
FIGS. 5A to 5C are explanatory views showing the operation of the photosensitive drum and the intermediate transfer belt in the image forming apparatus according to the embodiment of the invention.
Figure 5B:
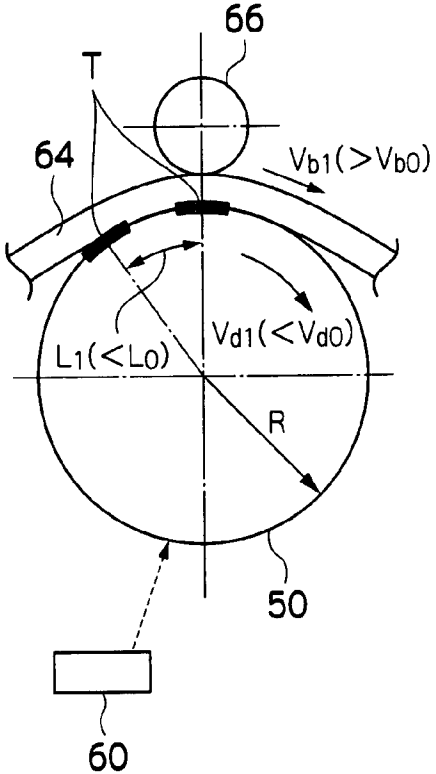
Figure 5C:
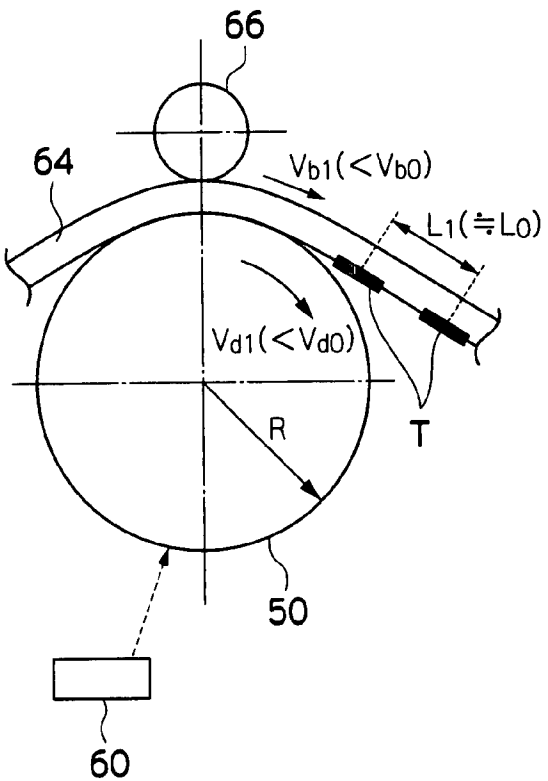

Next, in Step S6, after the primary transfer of the Y-color toner image is completed, the drive signal output unit 107 outputs the drive control drive signal to the motor 108 to change the rotation speed of the motor 108 to the optimum value with respect to the M-color image density computed in Step S2. Thus, as shown in FIGS. 5A to 5C, the photosensitive drum 50 is rotated at the optimum rotation speed Vd1 with respect to the density (coverage rate of 100%) of the M-color toner image which is to be electrostatically adsorbed on the photosensitive drum 50. Then, in Step S7, the photosensitive drum 50 is uniformly charged by the charging device 52, the photosensitive drum 50 is exposed by the exposure device 60 according to the M-color image data, the latent image on the photosensitive drum 50 is developed with the M-color toner by the development device 42M, and the M-color toner image is primary-transferred from the photosensitive drum 50 to the intermediate transfer belt 64 at the transfer nip portion between the primary transfer roller 66 and the photosensitive drum 50.

Figure 7B:
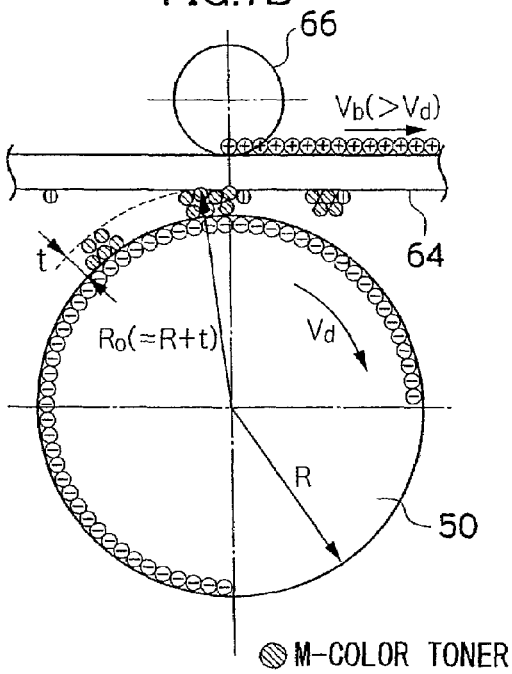

In the M-color process operation, as shown in FIG. 7B, since the amount of M-color toner which is electrostatically adsorbed on the photosensitive drum 50 is large, the drive radius R0 of the photosensitive drum 50 is increased by a thickness t of the M-color toner with respect to the actual radius R of the photosensitive drum 50. Therefore, as shown in FIG. 5B, moving speed Vb1 of the intermediate transfer belt 64 is faster than the moving speed Vb0 in the Y-color process operation.

Accordingly, rotation speed Vd1 of the photosensitive drum 50 is set to be slower than the rotation speed Vd0 in the Y-color process operation. Thus, the position where the electrostatic latent image S is formed on the photosensitive drum 50 by the exposure device 60 is moved toward the downstream side in the rotation direction, and the M-color toner image T on the photosensitive drum 50 reaches the transfer nip portion at a faster timing. Thereby, delay of the timing in which the M-color toner image is transferred from the photosensitive drum 50 to the intermediate transfer belt 64 is suppressed.

That is, as shown in FIGS. 5A and 5B, pitch L1 at which the photosensitive drum 50 is irradiated with the light beam from the exposure device 60 is shortened to be shorter than the pitch L0 in the Y-color exposure, so that the pitch L1 of the M-color toner image T is shortened to be shorter than the pitch L0 of the Y-color toner image T. Thereby, as shown in FIG. 5C, the pitch L1 of the M-color toner image T transferred to the intermediate transfer belt 64 is approximated to the pitch L0 of the Y-color toner image T. In this way, color displacement between the Y color and the M color is suppressed by coordinating the alignment of the writing positions of the Y-color toner image T and of the M-color toner image T on the intermediate transfer belt 64 along the belt rotation direction, as described above.

In Step S8, after the primary transfer of the M-color toner image is completed, the drive signal output unit 107 outputs the drive control signal to the motor 108 to change the rotation speed of the motor 108 to the optimum value with respect to the C-color image density computed in Step S2. Thus, as shown in FIG. 5B, the photosensitive drum 50 is rotated at the optimum rotation speed Vd1 with respect to the density (coverage rate of 100%) of the C-color toner image which is to be electrostatically adsorbed on the photosensitive drum 50. In this embodiment, because the toner density of the C-color toner image, which is electrostatically adsorbed on the photosensitive drum 50, is not changed, the rotation speed of the motor 108 is not changed. In Step S9, the photosensitive drum 52 is uniformly charged by the charging device 52, the photosensitive drum 50 is exposed by the exposure device 60 according to the C-color image data, the latent image on the photosensitive drum 50 is developed with the C-color toner by the development device 42C, and the C-color toner image is primary-transferred from the photosensitive drum 50 to the intermediate transfer belt 64 at the transfer nip portion between the primary transfer roller 66 and the photosensitive drum 50.

Figure 7C:
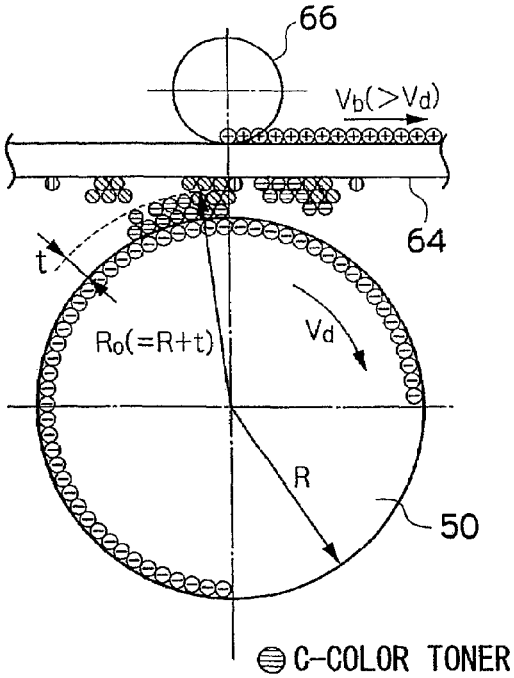

As shown in FIGS. 7B and 7C, in the primary transfer of the M color and the C color, because the same amount of toner is electrostatically adsorbed on the photosensitive drum 50, the photosensitive drum 50 becomes substantially the same drive radius R0, and the moving speed of the intermediate transfer belt 64 becomes substantially the same as the moving speed Vb1. Therefore, in the primary transfer of the M color and the C color, the photosensitive drum 50 is set at the same rotation speed Vd1, and the processes of the charging, the exposure, the development, and the transfer are performed at the same speed, so that the transfer positions of the M color and the C color are aligned with each other.

Accordingly, similarly to the primary transfer of the M color, the delay of the timing in which the C-color toner image is transferred from the photosensitive drum 50 to the intermediate transfer belt 64 can be suppressed.

In Step S10, after the primary transfer of the C-color toner image is completed, the drive signal output unit 107 outputs the drive control signal to the motor 108 to change the rotation speed of the motor 108 to the optimum value with respect to the K-color image density computed in Step S2. Thus, as shown in FIGS. 4A to 4C, the photosensitive drum 50 is rotated at the optimum rotation speed Vd0 with respect to the density (coverage rate of 2 to 3%) of the K-color toner image which is to be electrostatically adsorbed on the photosensitive drum 50. In Step S11, the photosensitive drum 50 is uniformly charged by the charging device 52, the photosensitive drum 50 is exposed by the exposure device 60 according to the K-color image data, the latent image on the photosensitive drum 50 is developed with the K-color toner by the development device 42K, and the K-color toner image is primary-transferred from the photosensitive drum 50 to the intermediate transfer belt 64 at the transfer nip portion between the primary transfer roller 66 and the photosensitive drum 50. Then, the processing routine is ended.

Figure 7D:
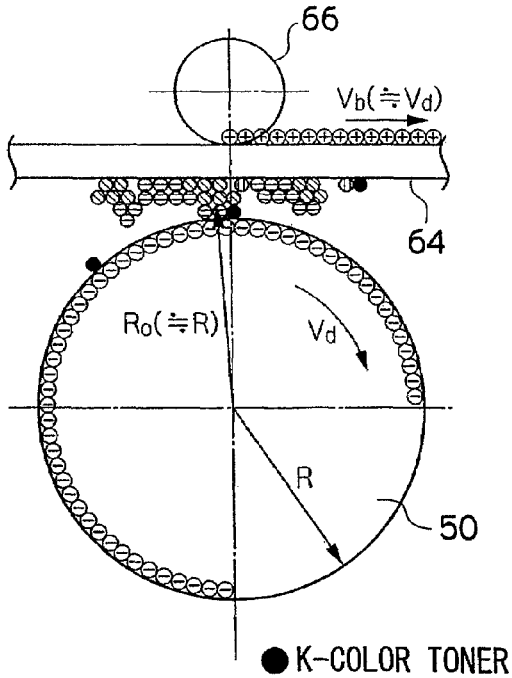
Figure 8A:
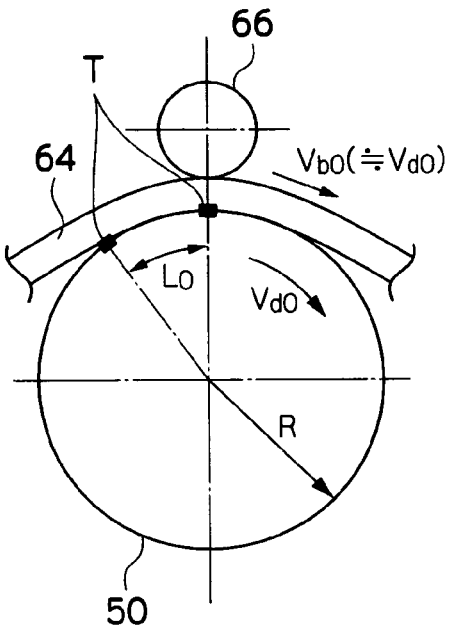
FIGS. 8A to 8D are explanatory views showing fluctuations in the moving speed of the intermediate transfer belt and fluctuations in the pitch of a toner image transferred to the intermediate transfer belt due to a change in the amount of toner electrostatically adsorbed to the photosensitive drum.
Figure 8B:
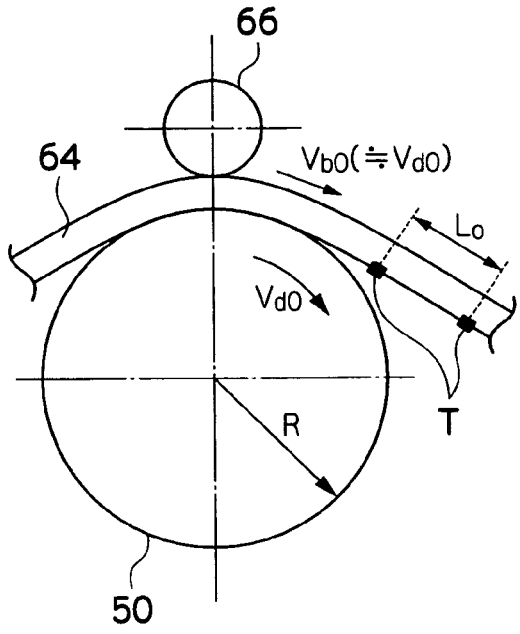
Figure 8C:
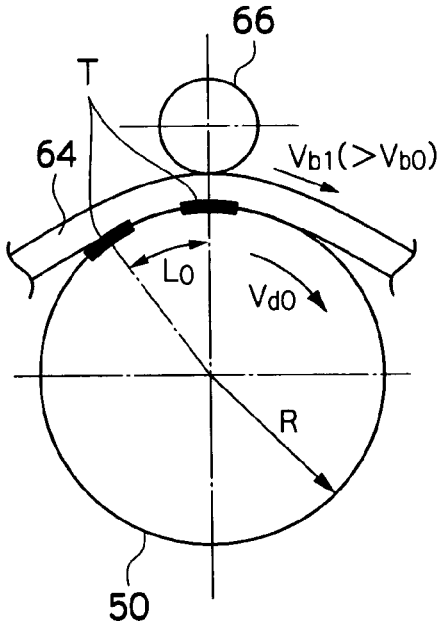
Figure 8D:
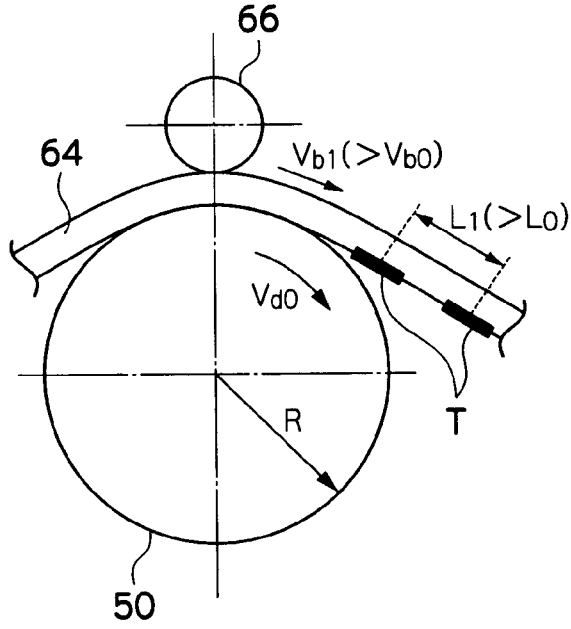

As shown in FIGS. 7A and 7D, in the primary transfer of the Y color and the K color, because the same amount of toner is electrostatically adsorbed on the photosensitive drum 50, the photosensitive drum 50 becomes substantially the same drive radius R0 (≈R), and the moving speed of the intermediate transfer belt 64 becomes substantially the same as the moving speed Vb0. Therefore, in the primary transfer of the Y color and the K color, the photosensitive drum 50 is set at the same rotation speed Vd0, and the processes of the charging, the exposure, the development, and the transfer are performed at the same speed, so that the transfer positions of the Y color and the K color are aligned with each other.

As described above, the writing positions of the Y, M, C, and K colors can be aligned with one another along the belt rotation direction on the intermediate transfer belt 64, and the development pitches of the Y, M, C, and K colors can be aligned with one another on the intermediate transfer belt 64. Thereby, a full-color print of high quality, having little color displacement, can be obtained.

The embodiment of the invention is described above only by way of example, and various modifications can be made without departing from the scope of the invention. It will be appreciated that the scope of the present invention is not limited to the described embodiment.

Namely, the present invention can be realized as an image forming apparatus including: a photosensitive body; a drive unit of the photosensitive body; an intermediate transfer body which is wound around the photosensitive body, the intermediate transfer body being driven by the movement of the driven photosensitive body; a latent image forming unit which forms an electrostatic latent image on the photosensitive body according to image information; a plurality of development units which develop the electrostatic latent image on the photosensitive body with toners respectively having different colors; a holding unit which holds the plurality of development units, the holding unit causing the development units to sequentially face the photosensitive body; a transfer unit which transfers a toner image from the photosensitive body to a portion of the intermediate transfer body where the intermediate transfer body is wound around the photosensitive body; and a drive speed control unit which controls the drive unit of the photosensitive body according to density of the toner image to be formed on the photosensitive body.

In the image forming apparatus, the drive speed control unit may control the drive unit such that a drive speed of the photosensitive body is decreased when the density of the toner image to be formed on the photosensitive body increases while the drive speed of the photosensitive body is increased when the density of the toner image to be formed on the photosensitive body decreases.

In this way, the position where the latent image forming unit forms the electrostatic latent image on the photosensitive body is moved toward the downstream side in the rotation direction, and the toner image reaches the transfer position with a faster timing. On the other hand, since the moving speed of the intermediate transfer body is increased due to the increase of the drive radius of the photosensitive body, the intermediate transfer body passes through the transfer position with a faster timing. Therefore, a delay in the timing at which the toner image is transferred from the photosensitive body to the intermediate transfer body is suppressed.

On the other hand, when the density of the toner image to be formed on the photosensitive body decreases, the drive speed control unit controls the drive unit to increase the rotation speed of the photosensitive body. Therefore, the position where the latent image forming unit forms the electrostatic latent image on the photosensitive body is moved toward the upstream side in the rotation direction so that the timing at which the toner image reaches the transfer position is delayed. On the other hand, the moving speed of the intermediate transfer body is decreased due to the decrease in the drive radius of the photosensitive body, and thereby the timing at which the intermediate transfer body passes through the transfer position is delayed. Therefore, the timing at which the toner image is transferred from the photosensitive body to the intermediate transfer body is suppressed from being too fast.

In the image forming apparatus, the drive speed control unit may include a computation unit which computes the density of the toner image to be formed on the photosensitive body from image information, and computes a drive speed of the photosensitive body, which is driven by the drive unit, according to the density; and a drive signal output unit which transmits a drive control signal to the drive unit, the drive control signal driving the drive unit (i.e., the photosensitive body) at the drive speed computed by the computation unit.

In the image forming apparatus, the computation unit computes the density of the toner image which is to be formed on the photosensitive body from the image information, and computes the drive speed of the photosensitive body, which is driven by the drive unit, according to the computed density. The drive signal output unit outputs a drive control signal to the drive unit. The drive control signal rotates the drive unit by which the photosensitive body is driven, at the drive speed computed by the computation unit. Thereby, the drive speed of the photosensitive body is changed according to the density of the toner image to be formed on the photosensitive body.

In the image forming apparatus, a computation expression or a parameter table for computing the drive speed of the drive unit may be stored in the computation unit. The computation expression or the parameter table may use a correlation whereby, given that an image density of 0% is the maximum speed and an image density of 100% is the minimum speed, the drive speed of the drive unit is gradually decreased as the image density increases, and the computation unit may compute the drive speed of the drive unit based on the correlation.

In the image forming apparatus, the intermediate transfer body may include an endless circular intermediate transfer belt.

In the image forming apparatus, the transfer unit may transfer respective color toner images one by one with each complete circuit of the intermediate transfer belt.

The image forming apparatus may further include a position detection unit which detects a specific position on the intermediate transfer body, wherein the transfer unit starts transfer of the toner image based on the specific position detected from the intermediate transfer body position detection unit, so that transfer start positions of the color toner images formed on the photosensitive body are aligned with one another.

In the image forming apparatus, the photosensitive body may include a cylindrical photosensitive drum which is rotated about a shaft thereof, and the drive speed control unit may control the drive unit to control a rotation speed of the photosensitive drum.

The present invention may also be realized as a method of transferring an image to an intermediate transfer body. The method includes: forming a toner image on a photosensitive body while driving the photosensitive body; controlling the driving according to density of the toner image to be formed; and transferring the toner image from the photosensitive body to the intermediate transfer body.

In the method of transferring an image to an intermediate transfer body, the controlling may include controlling the photosensitive body such that a drive speed of the photosensitive body is decreased when the density of the toner image to be formed on the photosensitive body increases while the drive speed of the photosensitive body is increased when the density of the toner image to be formed on the photosensitive body decreases.

In the method of transferring an image to an intermediate transfer body, the controlling may include computing the density of the toner image, which is to be formed on the photosensitive body, from image information, and computing a drive speed of the photosensitive body according to the density; and outputting a drive control signal for driving the photosensitive body at the drive speed computed by the computation.

In the method of transferring an image to an intermediate transfer body, the computation may include computing the drive speed of the photosensitive body based on a correlation whereby, when the drive speed is maximum when the image density is 0% and the drive speed is minimum when the image density is 100%, a rotation speed of the photosensitive body gradually decreases as the image density increases.

In the method of transferring an image to an intermediate transfer body, the intermediate transfer body includes an endless circular intermediate transfer belt, and driving the intermediate transfer body includes rotating the intermediate transfer belt.

In the method of transferring an image to an intermediate transfer body, the transferring includes superimposing respective color toner images on the intermediate transfer belt one by one with each complete circuit of the intermediate transfer belt.

The method of transferring an image to an intermediate transfer body may further include: detecting a specific position on the intermediate transfer body, wherein the transferring of the toner image is started based on the specific position detected by a detection unit, so that transfer start positions of respective color toner images formed on the photosensitive body are aligned with one another.

In the method of transferring an image to an intermediate transfer body, the controlling of the drive may include controlling a rotation speed of the photosensitive body.

Thus, because the invention has the above configuration, the invention can suppress variations in rotation period of the photosensitive body due to changes in the amount of toner which is electrostatically adsorbed to the photosensitive body.

What is claimed is:

1. An image forming apparatus comprising:

a photosensitive body;

a drive unit which drives the photosensitive body;

an intermediate transfer body which is wound around the photosensitive body, the intermediate transfer body being driven by the movement of the driven photosensitive body;

a latent image forming unit which forms an electrostatic latent image on the photosensitive body according to image information;

a plurality of development units which develop the electrostatic latent image on the photosensitive body with toners respectively having different colors;

a holding unit which holds the plurality of development units, the holding unit causing the development units to sequentially face the photosensitive body;

a transfer unit which transfers a toner image from the photosensitive body to a portion of the intermediate transfer body where the intermediate transfer body is wound around the photosensitive body; and a drive speed control unit which controls the drive unit of the photosensitive body according to density of the toner image to be formed on the photosensitive body.

2. The image forming apparatus of claim 1, wherein the drive speed control unit controls the drive unit such that a drive speed of the photosensitive body is decreased when the density of the toner image to be formed on the photosensitive body increases, while the drive speed of the photosensitive body is increased when the density of the toner image to be formed on the photosensitive body decreases.

3. The image forming apparatus of claim 1, wherein the drive speed control unit comprises:

a computation unit which computes the density of the toner image to be formed on the photosensitive body from image information, and computes a drive speed of the drive unit according to the density; and a signal output unit which transmits a drive control signal, to the drive unit, for driving the drive unit at the drive speed computed by the computation unit.

4. The image forming apparatus of claim 3, wherein a computation expression or a parameter table for computing the drive speed of the drive unit is stored in the computation unit, the computation expression or the parameter table includes a correlation whereby, when the drive speed is maximum when the image density is 0% and the drive speed is minimum when the image density is 100%, the drive speed of the drive unit gradually decreases as the image density increases, and the computation unit computes the drive speed of the drive unit based on the correlation.

5. The image forming apparatus of claim 1, wherein the intermediate transfer body includes an endless circular intermediate transfer belt.

6. The image forming apparatus of claim 5, wherein the transfer unit transfers respective color toner images one by one with each complete circuit of the intermediate transfer belt.

7. The image forming apparatus of claim 5, further comprising a position detection unit which detects a specific position on the intermediate transfer belt, wherein the transfer unit starts transfer of the toner image based on the specific position detected by the position detection unit, so that transfer start positions of color toner images formed on the photosensitive body are aligned with one another.

8. The image forming apparatus of claim 1, wherein the photosensitive body includes a cylindrical photosensitive drum which is rotated about a shaft thereof, and the drive speed control unit controls the drive unit to control a rotation speed of the photosensitive drum.

9. A method of transferring an image to an intermediate transfer body, the method comprising:

forming a toner image on a photosensitive body while driving the photosensitive body;

controlling the driving according to the density of the toner image to be formed; and transferring the toner image from the photosensitive body to the intermediate transfer body.

10. The method of transferring an image to an intermediate transfer body of claim 9, wherein the controlling of the driving of the photosensitive body includes controlling the photosensitive body such that a drive speed of the photosensitive body is decreased when the density of the toner image to be formed on the photosensitive body increases while the drive speed of the photosensitive body is increased when the density of the toner image to be formed on the photosensitive body decreases.

11. The method of transferring an image to an intermediate transfer body of claim 9, wherein the controlling of the driving of the photosensitive body includes;

computing the density of the toner image to be formed on the photosensitive body, from image information, and computing a drive speed of the photosensitive body according to the density; and outputting a drive control signal for driving the photosensitive body at the computed drive speed.

12. The method of transferring an image to an intermediate transfer body of claim 11, wherein the computing includes computing the drive speed of the photosensitive body based on a correlation whereby, when the drive speed is maximum when the image density is 0% and the drive speed is minimum when the image density is 100%, a rotation speed of the photosensitive body gradually decreases as the image density increases.

13. The method of transferring an image to an intermediate transfer body of claim 9, wherein the intermediate transfer body includes an endless circular intermediate transfer belt, and driving the intermediate transfer body includes rotating the intermediate transfer belt.

14. The method of transferring an image to an intermediate transfer body of claim 13, wherein the transferring includes superimposing respective color toner images on the intermediate transfer belt one by one with each complete circuit of the intermediate transfer belt.

15. The method of transferring an image to an intermediate transfer belt of claim 13, further comprising detecting a specific position on the intermediate transfer belt, wherein the transferring of the toner image is started based on the specific position detected by a detection unit, so that transfer start positions of respective color toner images formed on the photosensitive body are aligned with one another.

16. The method of transferring an image to an intermediate transfer body of claim 9, wherein the controlling of the driving includes controlling a rotation speed of the photosensitive body.

* * * * *